US006065992A

United States Patent [19]

Wu et al.

[11] Patent Number: 6,065,992

[45] Date of Patent: May 23, 2000

[54] GUIDE POST OF ELECTRICAL CONNECTOR

[75] Inventors: Kun-Tsan Wu, Tu-Chen; Johnson Yang, Tai-Shan, both of Taiwan

[73] Assignee: Hon Hai Precision Ind. Co., Ltd., Taipei Hsien, Taiwan

[21] Appl. No.: 09/333,766

[22] Filed: Jun. 15, 1999

[30] Foreign Application Priority Data

Nov. 17, 1998 [TW] Taiwan ..... 87219008

[51] Int. Cl.[7] ..... H01R 13/648

[52] U.S. Cl. ..... 439/383; 439/378

[58] Field of Search ..... 439/378–381, 439/152, 159, 382, 383

[56] References Cited

U.S. PATENT DOCUMENTS 5,092,774 3/1992 Milan ..... 439/378

FOREIGN PATENT DOCUMENTS 738207 5/1980 U.S.S.R. ..... 439/378

*Primary Examiner*—Gary F. Paumen

*Attorney, Agent, or Firm*—Wei Te Chung

[57] ABSTRACT

A guide post is adapted to be mounted to an electrical connector for being received in a receptacle hole defined in a mating connector to guide the mating operation of the connectors. The guide post has a threaded section threadingly engaging with an inner-threaded hole defined in the connector and a post section extending beyond the electrical connector and insertable into the receptacle hole of the mating connector. An intermediate section is formed between the threaded section and the post section. The intermediate section has a polygonal cross section with a circumferential groove formed therein. A helical spring having a first end received and retained in the circumferential groove surrounds the post section. The helical spring has a second end engageable with the mating connector when engaging the connectors together thereby providing a reaction force therebetween.

16 Claims, 3 Drawing Sheets

GUIDE POST OF ELECTRICAL CONNECTOR

BACKGROUND OF THE INVENTION

1. Field of the Invention

The present invention generally relates to a guide post of an electrical connector which guides the connector into mating engagement with a mating connector, and in particular to an electrical connector guide post having a buffering element for reducing an impact force between the connectors.

2. The Prior Art

Electrical connectors that engage with mating connectors to establish electrical connection therebetween are well known in the electronics field. A mating force is required to physically connect the connectors together. To ensure proper connection and to maintain secure engagement between the connectors, guiding means is often adapted in the connectors. Related examples are disclosed in U.S. Pat. Nos. 5,466,171 and 5,478,253 and Taiwan Patent Application No. 81212364. The guiding means of the conventional connector comprises an elongate post inserted into a hole defined in the mating connector. In the conventional connector, the mating force required to physically attach the connector to the mating connector is directly exerted upon the connectors whereby an unintentionally excessive mating force may damage the connectors when inserting the post into the hole.

It is thus desirable to provide a guide post which has a buffering spring for buffering the mating force thereby reducing the likelihood of damage from being incurred on the connectors.

SUMMARY OF THE INVENTION

Accordingly, an object of the present invention is to provide an electrical connector having a guide post with a buffering element for buffering impact acting upon the connector.

Another object of the present invention is to provide an electrical connector having a guide post with a buffering spring for providing electrical engagement with a mating connector and for providing EMI (Electro-Magnetic Interference) protection.

A further object of the present invention is to provide an electrical connector having a guide post with a buffering element for reducing the risk of damage from being incurred on the connector when engaging the connector with a mating connector.

To achieve the above objects, a guide post in accordance with the present invention which is adapted to be mounted to an electrical connector for being received in a receptacle hole defined in a mating connector to guide the mating operation of the connectors, comprises a threaded section threadingly engaging with an inner-threaded hole defined in the connector and a post section extending beyond the electrical connector and insertable into the receptacle hole of the mating connector. An intermediate section is formed between the threaded section and the post section. The intermediate section has a polygonal cross section with a circumferential groove formed therein. A helical spring having a first end received and retained in the circumferential groove surrounds the post section. The helical spring has a second end engageable with the mating connector when the connectors are engaged together thereby providing a reaction force therebetween.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
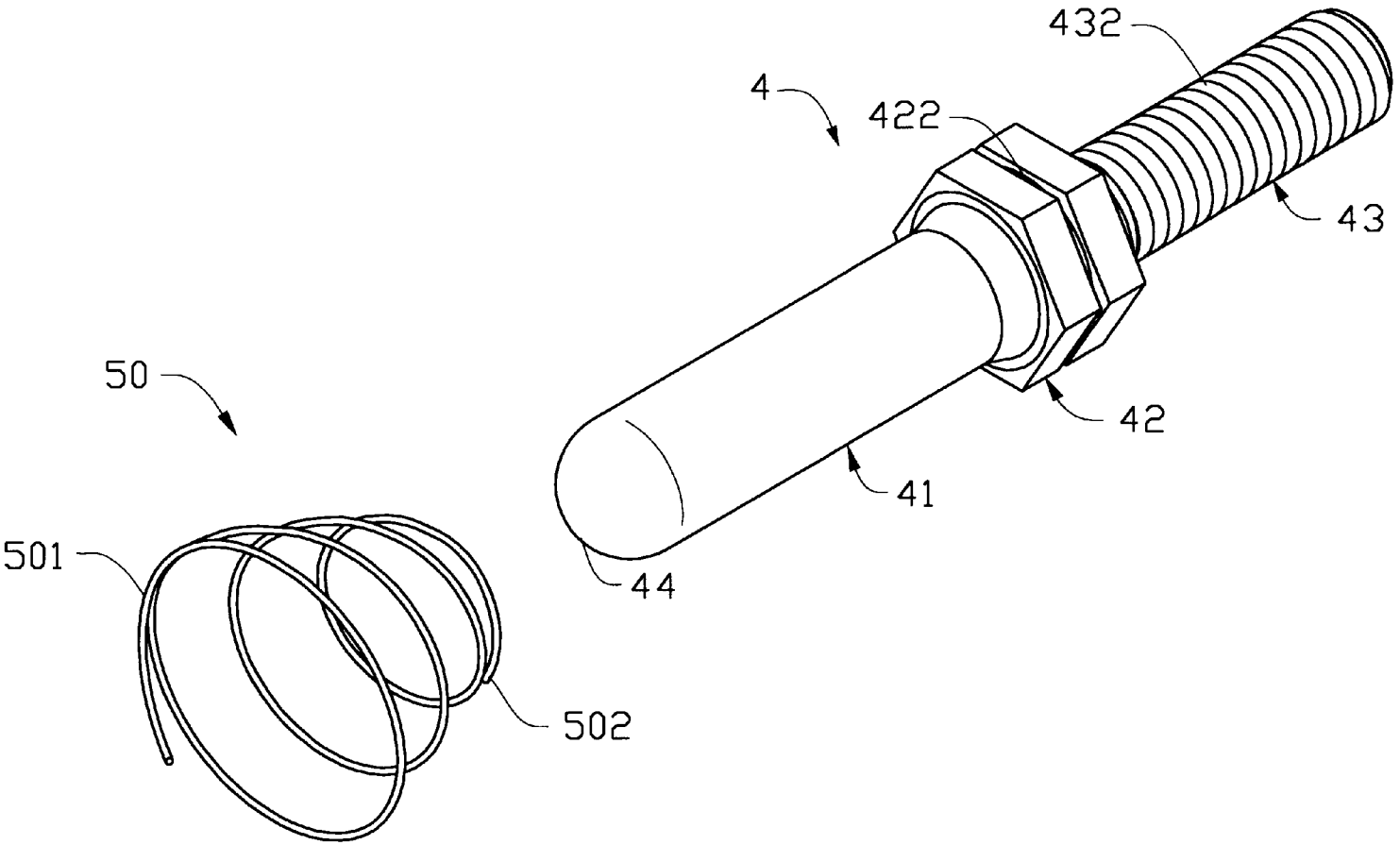
FIG. 1 is an exploded view of a guide post in accordance with the present invention, adapted to be mounted to an electrical connector.

Referring to the drawings and in particular to FIG. 1, a guide post 4 in accordance with the present invention comprises an elongate body having a front post section 41 and a rear fixing section 43 extending from an intermediate section 42 in opposite directions. The fixing section 43 has an external threading 432. The fixing section 43 is adapted to be inserted into a hole 34 (FIGS. 2, 3A and 3B) defined in an insulative housing 3 of an electrical connector 1 with the post section 41 extending beyond a front face 31 of the connector housing 3. The hole 34 of the connector 1 has inner threads 35 (FIGS. 3A and 3B) for threadingly engaging with the external threading 432 of the fixing section 43 thereby securing the post 4 to the connector 1.

Figure 2:
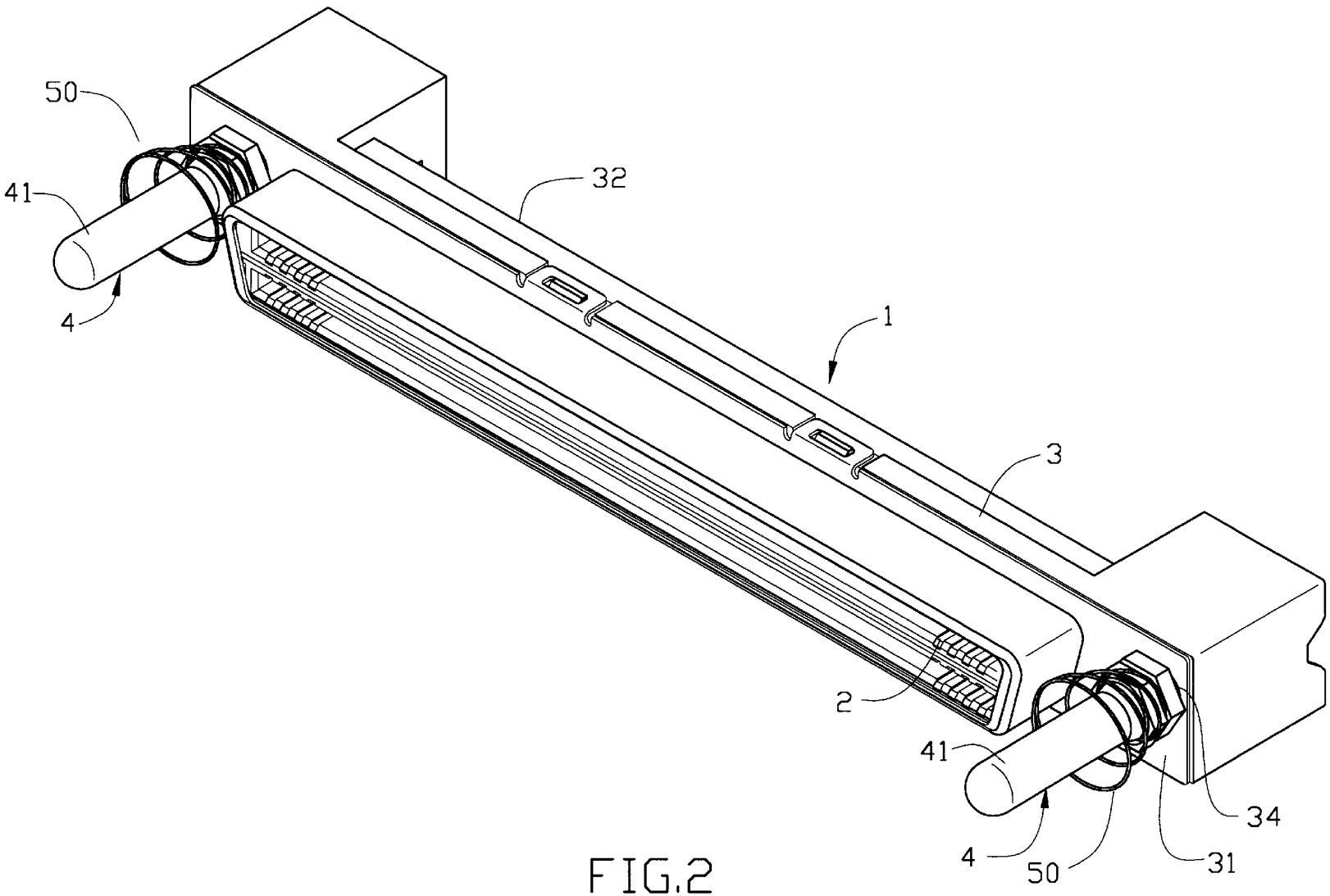
FIG. 2 is a perspective view of the electrical connector having two guide posts of the present invention mounted thereto.

As shown in FIG. 2, preferably, the connector 1 has two guide posts 4 mounted thereto at opposite ends of the housing 3 and extending beyond the front face 31. The connector 1 comprises a plurality of contact elements 2 retained in the housing 3 with opposite ends of the contact elements 2 respectively extending to or beyond the front face 31 and a rear face 32 of the housing 3.

The intermediate section 42 has a polygonal cross-section, such as a hexagon as shown. The polygonal shape of the intermediate section 42 facilitates handling of the guide post 4 by an external tool. For example, a wrench (not shown) may be used to mount the guide post 4 to the connector 1. A circumferential groove 422 is formed around the intermediate section 42.

Figure 3B:
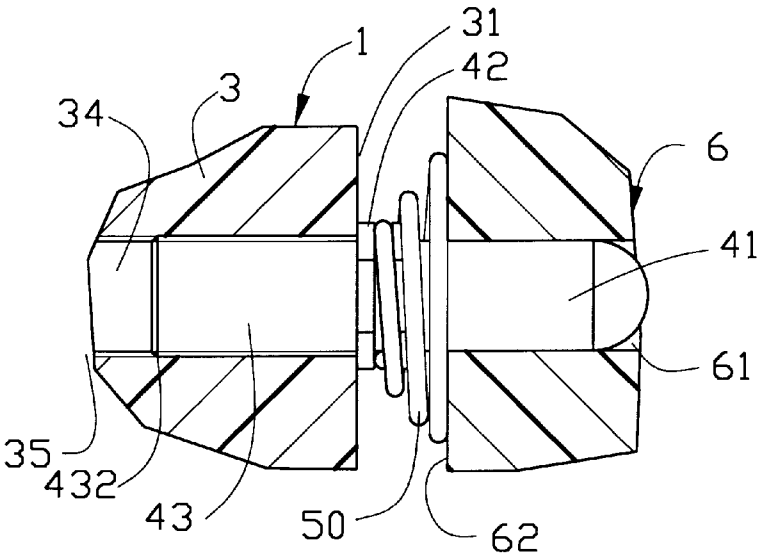
FIG. 3B is a cross-sectional view showing the guide post completely inserted into the corresponding hole of the mating connector.
Figure 3A:
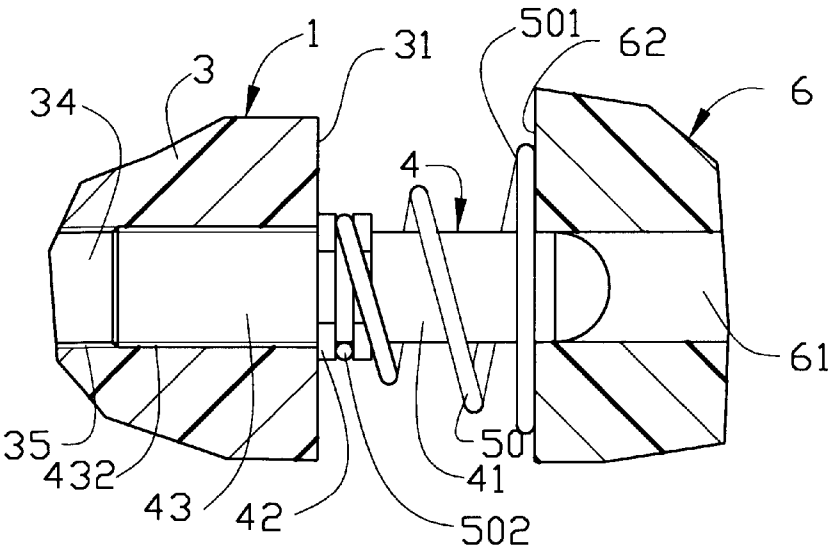
FIG. 3A is a cross-sectional view showing the guide post partially inserted into a corresponding receptacle hole of a mating connector.

A buffering element, such as a helical spring 50, is mounted to and surrounds the post section 41 of the guide post 4. The helical spring 50 has a first end 502 received and retained in the circumferential groove 422 of the intermediate section 42 and a second end 510 adapted to engage with a mating connector 6 (FIGS. 3A and 3B). Preferably, the helical spring 5 has a conical configuration whereby the second end 501 has a larger diameter than the first end 502. The conical configuration of the helical spring 50 allows the spring 50 to be compressed to form a flat coil (FIG. 3B) and improves engagement with the mating connector 6. The helical spring 50 also provides additional grounding for the mating connector 6.

When engaging the connector 1 with the mating connector 6 as shown in FIGS. 3A and 3B, the post section 41 of the guide post 4 is aligned with and inserted into a receptacle hole 61 defined in a mating face 62 of the mating connector 6. The large end 501 of the spring 50 is brought into engagement with the mating face 62 of the mating connector 6. A mating force is applied to the connectors 1, 6 to compress the spring 50 and further insert the post section 41 into the receptacle hole 61 for bringing the connectors 1, 6 toward each other and electrically engaging the contact elements 2 of the connector 1 with counterpart contacts (not shown) of the mating connector 6.

The compression of the spring 50 provides a buffering force to the mating operation between the connectors 1, 6. Thus, the connectors 1, 6 are protected against damage caused by the mating force. Preferably, the post section 41 has a rounded free end 44 for facilitating insertion of the post section 41 into the receptacle hole 61.

Although the present invention has been described with reference to a preferred embodiment, it is apparent to those skilled in the art that a variety of modifications and changes may be made without departing from the scope of the present invention which is intended to be defined by the appended claims.

What is claimed is:

1. A guide post adapted to be mounted to a first electrical connector for being received in a receptacle hole defined in a mating second connector for guiding the first connector into mating engagement with the second connector, the guide post comprising a post section extending from the first connector and insertable into the receptacle hole of the second connector and a buffering element mounted to the post section for providing a reaction force between the two connectors when mating the connectors together.

2. The guide post as claimed in claim 1, wherein the post section has a rounded free end.

3. The guide post as claimed in claim 1 further comprising an externally-threaded section for threadingly engaging with an inner-threaded hole defined in the first connector for mounting the guide post to the first connector.

4. The guide post as claimed in claim 3, wherein an intermediate section is formed between the post section and the threaded section, the intermediate section having a polygonal configuration.

5. The guide post as claimed in claim 4, wherein the polygonal configuration is hexagonal.

6. The guide post as claimed in claim 1, wherein the buffering element comprises a helical spring surrounding the post section, the helical spring having a first end fixed to the guide post and an opposite second end adapted to engage with the second connector.

7. The guide post as claimed in claim 6, wherein a circumferential groove is formed around the guide post for receiving and retaining the first end of the helical spring.

8. The guide post as claimed in claim 6, wherein the helical spring has a conical configuration, the second end having a diameter greater than the first end.

9. The guide post as claimed in claim 4, wherein the buffering element comprises a helical spring surrounding the post section, the helical spring having a first end fixed to the guide post and an opposite second end adapted to engage with the second connector.

10. A guide post adapted to be mounted to a first electrical connector for being received in a receptacle hole defined in a mating second connector to guide a mating operation of the connectors, the guide post comprising a threaded section threadingly engaging with an inner-threaded hole defined in the first connector and a post section extending from the first connector and insertable into the receptacle hole of the second connector, an intermediate section being formed between the threaded section and the post section, the intermediate section having a polygonal cross section with a circumferential groove formed therein and a helical spring having a first end received and retained in the circumferential groove and surrounding the post section, the helical spring having a second end engageable with the second connector when mating the connectors together thereby providing a reaction force between the two connectors.

11. The guide post as claimed in claim 10, wherein the helical spring has a conical configuration, the second end having a diameter greater than the first end.

12. An electrical connector comprising an insulative body retaining contact elements therein and adapted to mate with an external connector for electrically engaging the contact elements with counterpart contacts of the external connector, and guiding means mounted to the housing for guiding the electrical connector into mating engagement with the external connector, the guiding means having at least one post section extending from the connector and receivable in a receptacle hole defined in the external connector, buffering means being provided on the connector to provide a reaction force between the connectors when mating the connectors together, wherein the guiding means comprises a guide post fixed to the connector housing and having the post section extending from the connector housing, and the buffering means comprises a helical spring surrounding the post section, the helical spring having a first end fixed to the guide post and an opposite second end adapted to engage with the external connector.

13. The electrical connector as claimed in claim 12 further comprising an externally-threaded section threadingly engaging with an inner-threaded hole defined in the connector for mounting the guide post to the connector.

14. The electrical connector as claimed in claim 13, wherein an intermediate section is formed between the post section and the threaded section, the intermediate section having a polygonal configuration.

15. The electrical connector as claimed in claim 12, wherein a circumferential groove is formed around the guide post for receiving and retaining the first end of the helical spring.

16. The electrical connector as claimed in claim 12, wherein the helical spring has a conical configuration, the second end of the spring having a diameter greater than the first end thereof.

* * * * *